US005554924A

United States Patent [19]

McMahon et al.

[11] Patent Number: 5,554,924

[45] Date of Patent: Sep. 10, 1996

[54] HIGH SPEED SHUNT REGULATOR

[75] Inventors: Jerry K. McMahon, Apalachin, N.Y.; Floyd W. Olsen, Athens, Pa.; Matthew F. Seward, Windsor, N.Y.

[73] Assignee: International Business Machines Corporation, Armonk, N.Y.

[21] Appl. No.: 508,852

[22] Filed: Jul. 27, 1995

[51] Int. Cl.[6] ..... G05F 1/613; G05F 1/618; G05F 3/16

[52] U.S. Cl. ..... 323/229; 323/225

[58] Field of Search ..... 323/220, 223, 323/225, 229, 231

[56] References Cited

U.S. PATENT DOCUMENTS

| | | | |
|---|---|---|---|
| 4,213,082 | 7/1980 | Wisner et al. | 323/17 |
| 4,290,005 | 9/1981 | Arumugham | 323/313 |
| 4,366,432 | 12/1982 | Noro | 323/224 |
| 4,603,289 | 6/1986 | McLellan | 323/277 |
| 4,686,451 | 8/1987 | Li et al. | 323/313 |
| 4,785,230 | 11/1988 | Ovens et al. | 323/313 |
| 4,948,989 | 8/1990 | Spratt | 307/296.6 |
| 4,982,318 | 1/1991 | Maeba et al. | 363/63 |
| 5,013,999 | 5/1991 | Yamada | 323/313 |
| 5,130,636 | 7/1992 | Kumar et al. | 323/278 |
| 5,153,453 | 10/1992 | Walters | 307/317.1 |

OTHER PUBLICATIONS

IBM Technical Disclosure Bulletin vol. 15, No. 3, Aug. 1972, "Regulated MOSFET Power Supply Device", pp. 817–818, by Beilstein et al.

*Primary Examiner*—Peter S. Wong
*Assistant Examiner*—Bao Q. Vu
*Attorney, Agent, or Firm*—Arthur J. Samodovitz

[57] ABSTRACT

A high speed shunt regulator comprises a DC current source, a DC voltage reference/current shunt circuit, and first and second Schottky diodes connected in series with each other between the DC current source and the DC voltage reference/current shunt circuit. An output port for the load is connected between the first and second Schottky diodes. The Schottky diodes have little parasitic capacitance and virtually no reverse recovery. Consequently, the amount of current passing through the Schottky diodes can change in one nanosecond and the shunt regulator can accommodate high frequency fluctuations in the load while maintaining rated voltage. In other words, the Schottky diodes serve the function of "isolating" the slower semiconductors of the DC current source and reference voltage/current shunt circuit from the load.

15 Claims, 2 Drawing Sheets

HIGH SPEED SHUNT REGULATOR

BACKGROUND OF THE INVENTION

The present invention relates generally to shunt regulators and deals more particularly with a high speed shunt regulator for supplying a load at a precise voltage level, despite high frequency fluctuations in load current.

A prior art, shunt type of voltage regulator operates from a DC source of higher voltage than the rated output voltage. The shunt regulator generates a DC current from the DC source, and the DC current flows to the load. The shunt regulator also comprises a voltage reference/current shunt circuit connected to the current source and load to shunt current not required by the load and establish a specified load voltage. For applications requiring a low shunt current, the voltage reference/current shunt circuit comprises a zener diode in parallel with the load to shunt current not required by the load and establish the load voltage. For other applications requiring a higher shunt current, the voltage reference/current shunt circuit comprises a zener diode and a pnp transistor whose base is connected to the zener diode to establish the reference voltage and whose emitter to collector path shunts the excess current to ground.

The advantage of a shunt regulator is the precision of the output voltage and ability to accommodate high frequency fluctuations in load current while maintaining rated voltage. The disadvantage is the loss of power in the zener diode and/or shunt transistor (which is not delivered to the load). The foregoing shunt regulators cannot handle very high frequency fluctuations in load current because of capacitances inherent in the current source, zener diode and transistor.

Accordingly, a general object of the present invention is to provide a shunt regulator which can handle higher frequency fluctuations in load current than the prior art shunt regulators.

SUMMARY OF THE INVENTION

The invention resides in a shunt regulator comprising a DC current source, a DC voltage reference/current shunt circuit, and first and second Schottky diodes connected in series with each other between the DC current source and the DC voltage reference/current shunt circuit. An output port for the load is connected between the first and second Schottky diodes. The Schottky diodes have little parasitic capacitance and virtually no reverse recovery. Consequently, the amount of current passing through the Schottky diodes can change in one nanosecond and the shunt regulator can accommodate high frequency fluctuations in the load while maintaining rated voltage. In other words, the Schottky diodes serve the function of "isolating" the slower semiconductors of the DC current source and reference voltage/current shunt circuit from the load.

According to one feature of the present invention, a capacitor is connected in parallel with the series arrangement of the Schottky diodes to supply the high frequency load current fluctuations.

DETAILED DESCRIPTION OF THE PREFERRED EMBODIMENT

Figure 1:
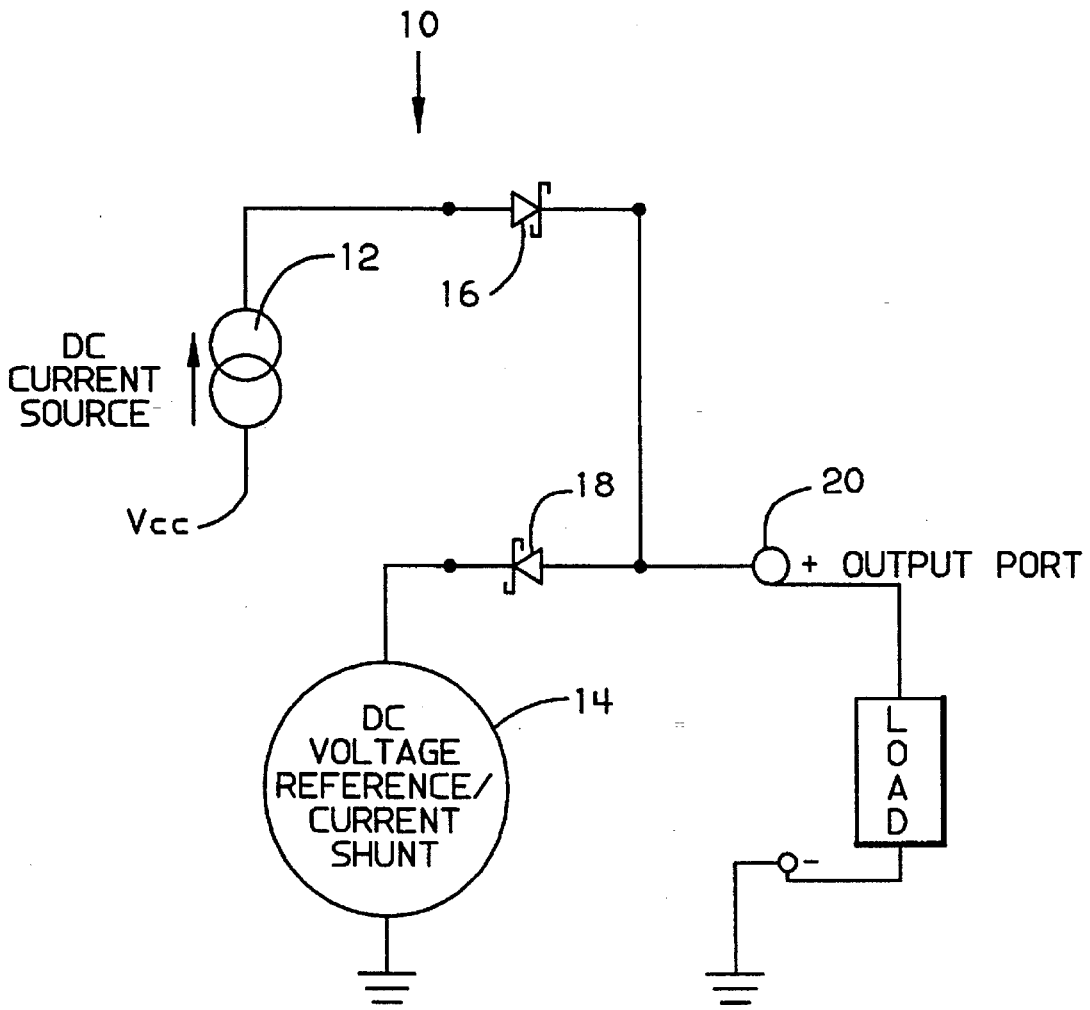
FIG. 1 is a circuit diagram of the present invention.

Referring now to the drawings in detail wherein like reference numbers indicate like elements, FIG. 1 illustrates a shunt type of regulator generally designated 10 according to the present invention. Regulator 10 comprises a DC current source 12, DC reference voltage/current shunt circuit 14 and Schottky diodes 16 and 18 connected in series with each other between the current source 12 and the reference voltage/current source 14.

The DC current source 12 injects a DC current through Schottky diode 16 to the load (as required by the load) via output port 20 with the remainder of the current passing through Schottky diode 18 to reference voltage/current shunt circuit 14 (bypassing the load). Thus, the DC source continuously delivers a fixed level of current with the amount not drawn by the load being dissipated in the reference voltage/current shunt circuit. The simplest form of the reference voltage/current shunt circuit is a reversed biased zener diode, with the breakdown voltage being 0.4 volts (one Schottky diode drop) less than the rated voltage output of the regulator.

The Schottky diodes 16 and 18 have little parasitic capacitance and virtually no reverse recovery; the amount of current passing through the Schottky diodes 16 and 18 can change in one nanosecond. Therefore, because of the Schottky diodes 16 and 18, the regulator 10 can accommodate high frequency fluctuations in load while precisely maintaining rated voltage. In other words, the Schottky diodes 16 and 18 serve the function of "isolating" the slower semiconductors of the DC current source 12 and reference voltage/current shunt circuit 14 from the load. Consequently, the response time of the shunt regulator 10 is much faster than in the prior art. Also, the Schottky diodes participate in the "steerage" of current such that the load obtains all the required current and the excess is passed to the reference voltage/current shunt circuit. In summary, the steering Schottky diodes respond within a nanosecond to changes in load voltage & current and counteract these changes instantaneously by adding current to the load or adding current to the shunt circuit as required. Because there is current continuously flowing, there is no component lag time associated with counteracting these changes.

Figure 2:
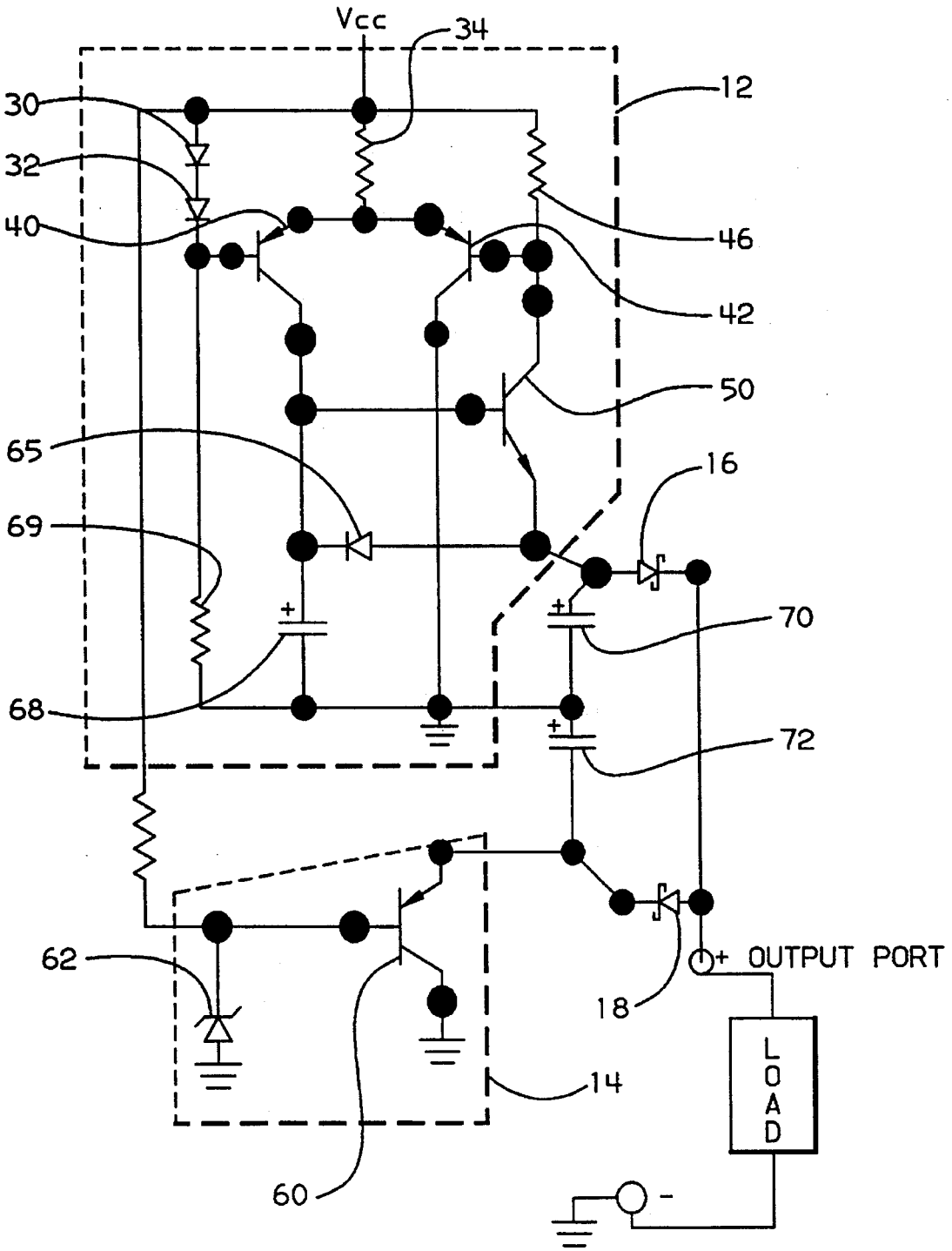
FIG. 2 is a more detailed circuit diagram of the present invention.

FIG. 2 illustrates DC source 12 and reference voltage/current shunt circuit 14 in more detail. Standard (silicon) diodes 30 and 32 limit the voltage across resistor 34 and the emitter to base junction of PNP transistor 40 to 1.4 volts. This limits the current through resistor 34 and the current into the emitter to base junction of another PNP transistor 42. Because of the 0.7 volt drop across resistor 34 and the 0.7 volt drop across the emitter to base junction of (silicon) transistor 42, the voltage across resistor 46 is 1.4 volts and the current through resistor 46 is the resistance of resistor 46 divided into 1.4 volts. The current through the collector to emitter junction of a transistor 50 is approximately the sum of the current through the emitter to base junction of transistor 42 and resistor 46 which is approximately known. (Diode 65 protects transistor 50 from excess reverse bias of the emitter to base junction. Capacitor 68 provides high frequency stability for transistors 40, 42 and 50. Resistor 69 provides a current path for diodes 30 and 32 to establish the reference voltage at the base of transistor 40.)

The current from transistor 50 is injected through Schottky diode 16 to the load with the remainder passing through Schottky diode 18 to a PNP transistor 60. The voltage at the output is determined by the breakdown voltage of a zener diode 62 plus the 1.1 voltage drop across Schottky diode 18 and the emitter to base junction of (silicon) transistor 60; transistor 60 is inserted between the output and the zener diode 62 to increase the current shunting capacity of the regulator 10. Capacitors 70 and 72 provide a high frequency charge/current reserve for the output. By way of example, capacitors 70 and 72 are each 680 microfarads, and the load is a nominal 5 amps at 18 volts.

Based on the foregoing, a shunt regulator according to the present invention has been disclosed. However, numerous modifications and substitutions can be made without deviating from the scope of the present invention. For example, the silicon diodes and transistors of regulator 10 can be replaced by germanium ones with corresponding reductions in the magnitudes of resistors 34 and 46. Also, the Schottky diodes can be formed from gallium arsenide instead of silicon. Also, other known DC current sources (with current limiters) can be substituted for DC current source 12. Also, other types of DC reference voltage/current shunt circuits can be substituted for reference voltage/current shunt circuit 14. Therefore, the invention has been disclosed by way of illustration and not limitation and reference should be made to the following claims to determine the scope of the present invention.

We claim:

1. A shunt regulator comprising:

a source of DC current;

a DC voltage reference/current shunt circuit;

first and second Schottky diodes connected in series with each other between said source and said DC voltage reference/current shunt circuit and oriented to pass DC current of said source to a load and said DC voltage reference/current shunt circuit, an output port for said load being coupled between said first and second Schottky diodes.

2. A shunt regulator as set forth in claim 1 wherein said first and second Schottky diodes are directly connected to one another, and said output port is the junction between said first and second Schottky diodes.

3. A shunt regulator as set forth in claim 2 further comprising first and second capacitors connected in series with each other and in parallel with the series arrangement of said first and second Schottky diodes, a junction between said first and second capacitors being connected to an AC decoupling reference.

4. A shunt regulator as set forth in claim 1 further comprising capacitor means, connected in parallel with the series arrangement of said first and second Schottky diodes, for providing high frequency current reserve for the load.

5. A shunt regulator as set forth in claim 1 further comprising first and second capacitors connected in series with each other and in parallel with the series arrangement of said first and second Schottky diodes.

6. A shunt regulator as set forth in claim 5 wherein a junction between said first and second capacitors is connected to ground.

7. A shunt regulator as set forth in claim 1 wherein said DC reference/current shunt circuit comprises a zener diode whose breakdown voltage establishes the DC reference.

8. A shunt regulator as set forth in claim 7 wherein said DC reference/current shunt circuit further comprises a transistor having a base coupled to said zener diode and a collector to emitter path coupled to said second Schottky diode.

9. A shunt regulator as set forth in claim 8 wherein said collector to emitter path is connected to said second Schottky diode.

10. A shunt regulator as set forth in claim 9 wherein a cathode of said first Schottky diode is connected to an anode of said second Schottky diode, and said output port is connected between said cathode of said first Schottky diode and said anode of said second Schottky diode.

11. A shunt regulator as set forth in claim 1 wherein said source of DC current is a DC current source.

12. A shunt regulator as set forth in claim 1 wherein said source of DC current comprises a current limiter.

13. A shunt regulator comprising:

a source of DC current;

means for establishing a DC reference voltage;

means for shunting current into the establishing means; and first and second Schottky diodes connected in series with each other between said source and the shunting means, said diodes being oriented to pass DC current of said source to a load and said shunting means, an output port for said load being coupled between said first and second Schottky diodes.

14. A shunt regulator as set forth in claim 13 wherein said establishing means comprises a zener diode.

15. A shunt regulator as set forth in claim 14 wherein said shunting means comprises a pnp transistor having an emitter coupled to said output port and a base coupled to a cathode of said zener diode.

* * * * *